United States Patent [19]

Ryckman, deceased

[11] 4,368,021

[45] * Jan. 11, 1983

[54] OVAL DISH FORMING METHOD AND MACHINE

[75] Inventor: George Ryckman, deceased, late of East Liverpool, Ohio, by Margaret V. Ryckman, executrix

[73] Assignee: Service (Engineers) Limited, Stoke-on-Trent, England

[ * ] Notice: The portion of the term of this patent subsequent to Sep. 1, 1998, has been disclaimed.

[21] Appl. No.: 239,639

[22] Filed: Mar. 2, 1981

Related U.S. Application Data

[63] Continuation-in-part of Ser. No. 29,288, Apr. 4, 1979, Pat. No. 4,286,938.

[30] Foreign Application Priority Data

Apr. 10, 1980 [GB] United Kingdom ..... 8011908

[51] Int. Cl.[3] ..... B28B 1/02; B28B 1/29

[52] U.S. Cl. ..... 425/265; 425/266; 425/267; 425/268; 425/405 R; 425/409; 425/429

[58] Field of Search ..... 425/265, 266, 267, 268, 425/405 R, 409, 429

[56] References Cited

U.S. PATENT DOCUMENTS 4,286,938 9/1981 Ryckman ..... 425/265

*Primary Examiner*—John A. Parrish
*Attorney, Agent, or Firm*—Harpman & Harpman

[57] ABSTRACT

For the manufacture of oval dishes, a machine has two work supports arranged to rotate moulds eccentrically for clay on the moulds to be shaped into oval forms. At a first, spreading, station the clay is engaged by a pancake-type spreading roller which squeezes a piece of clay into an oval shape. The mould is transferred to a second, or finishing, station where a finishing roller rolls the clay to the desired configuration of the oval dish. The spreading roller is driven. The finishing roller may be driven or it may rotate freely, a brake being applied to the free roller, for the end of a finishing operation, to improve the surface finish of the ware.

19 Claims, 20 Drawing Figures

OVAL DISH FORMING METHOD AND MACHINE

SPECIFIC DESCRIPTION

This application is a continuation-in-part from patent application Ser. No. 029,288 filed Apr. 4, 1979 in the name of George Ryckman now U.S. Pat. No. 4,286,938.

In the past, ceramic oval dishes have in the main been manufactured by a process which is both slow and required considerable skill from the potter. Starting with a lump of moist clay, the potter placed the lump on a potter's wheel and shaped it on the wheel with the aid of a blade into the form of a thin disc. He then peeled the thin disc of clay from the wheel and transferred it to an oval dish mould for formation of a dish. The mould was eccentrically rotated by the mould support, and the potter manually applied a pivotally mounted profile tool, in the form of a blade, to the clay to shape it against the mould.

As stated, this known method and apparatus require considerable skill from the potter if satisfactory ware is to be produced. Firstly, the operation of forming a thin clay disc from a lump and transferring the disc from the wheel to the mould demands substantial skill; there is not only a danger of damaging the thin disc, but the operation of forcefully positioning the disc on the mould, so as to obtain an even spread of the clay over the mould without air inclusions and deformities, is of itself not easy. Secondly, the application of the profile tool to shape the clay on the mould has to be done with great care and attention if the clay is to be formed as required, without damage and without leaving residual stresses in the clay which could lead to later deformation of the ware.

There has been proposed in U.S. Pat. No. 2,485,159 (Malarkey) a machine for jiggering oval dinnerware in which a profile tool is arranged to be moved elliptically above a stationary dish mould, to shape clay into conformity with the mould and so form an oval dish. The mould is mounted on the end of a pivotally movable arm for bringing the mould to the tool and separation of the mould from the tool after formation of a piece of ware.

The Malarkey patent describes a machine which essentially attempts to mechanise the traditional, largely manual, method referred to hereinbefore, except that the machine moves the profile tool along an elliptical path rather than rotate the mould eccentrically. Formation of the clay is by means of a single profile tool in substantially a single forming operation. Shortly after the Malarkey patent issued in 1949, roller tools were introduced to the trade (around 1953) and since that time roller tools have become very widely used, in preference to profile tools, for fully mechanised production of circular ceramic ware. However, there remains, even thirty years since the Malarkey patent issued, a requirement for machines employing roller tools for the automatic production of oval flatware of a high quality and at commercially acceptable rates of production.

It is an object of the invention to provide a method by which oval flatware of a high quality can be manufactured fast and without requiring great skill from an operator.

It is a further object of the invention to provide a machine suitable for use in performance of the method.

According to the invention a method of forming oval flatware in the manufacture of ceramic ware comprises the steps:

- placing a piece of clay on an oval mould against which the clay is to be shaped;
- eccentrically rotating the mould beneath a rotatable roller shaping tool which is in the form of a spreading tool (as hereinafter defined);
- engaging the clay on the mould with the spreading tool so that the tool spreads the clay over the mould to provide a preformed clay piece;
- eccentrically rotating the mould with the preformed clay piece thereon beneath a rotatable roller shaping tool which is in the form of a finishing tool (as hereinafter defined); and
- engaging the preformed clay piece on the mould with the finishing tool so that the tool performs a final shaping operation on the clay piece.

By a spreading tool (where the term is used herein) is meant a tool arranged to perform primarily spreading and initial shaping operations on a disc of clay placed on the mould. A tool of this kind, sometimes referred to as a "pancake" type, has a generally conical form with an obtuse apical angle; such a tool is usually arranged to operate with its axis of rotation at an angle of within the range of 15° to 22½° to the axis of rotation of the mould support. The spreading tool can quickly spread the disc of clay over the mould to provide a preformed clay piece.

By a finishing tool (where the term is used herein) is meant a tool arranged to perform primarily a final shaping operation on clay which has been preformed in the first stage. The finishing tool can also serve to give the clay a reqired smooth surface. The tool can be of a conical type with an acute apical angle, arranged to operate with its axis of rotation inclined at up to about 22½° above a radius to the axis of rotation of the mould support (a positive angle), a cylindrical type arranged to operate with its axis lying co-axially with the radius, or a so-called dumb-bell type, arranged to operate at a negative angle (up to about 10°) to the radius. The dumb-bell type may be found particularly desirable where a steep-sided foot is to be formed on the base of the ware.

In another of its aspects the invention provides a machine for forming oval flatware in the manufacture of ceramic ware comprising first and second mould supports, mechanism for rotating each of the mould supports eccentrically beneath a roller shaping tool for the shaping of a piece of clay on an oval mould on the mould support, a first tool supporting head associated with the first mould support and carrying a rotatable roller tool in the form of a spreading tool (as hereinbefore defined), a second tool supporting head associated with the second mould support and carrying a rotatable roller tool in the form of a finishing tool (as hereinbefore defined), and tool advancing means operable to bring the roller tools on their tool supporting heads into engagement with pieces of clay on moulds positioned on the eccentrically rotating mould supports, whereby in use of the machine a clay piece can initially undergo a spreading and initial shaping operation by the action of the spreading tool whilst the mould is eccentrically rotated by the first mould support, and then undergo a final shaping operation by the action of the finishing tool whilst the mould is eccentrically rotated by the second mould support.

The tool supporting heads are preferably pivotally mounted to bring the tools into engagement with, and work on, the clay. Preferably the speed of approach of the spreading tool to the mould is reduced as it approaches the end of its stroke, and the tool may then dwell at the end of its stroke for up to a few seconds before being lifted away from the mould.

In the first, spreading, stage the mould may with advantage be rotated initially at a first speed and thereafter at a higher speed.

Should it be desired to form a so-called foot (in the form of a continuous raised bead) on the ware, this may be best achieved by means of a circumferential groove in the finishing tool, though formation of the foot may be started by the spreading tool.

The invention makes it possible for oval flatware to be manufactured reliably in large quantities and at speed.

There now follows a description, to be read with reference to the accompanying drawings, of two forming machines and their use, which illustrate the invention by way of example.

Figure 1:
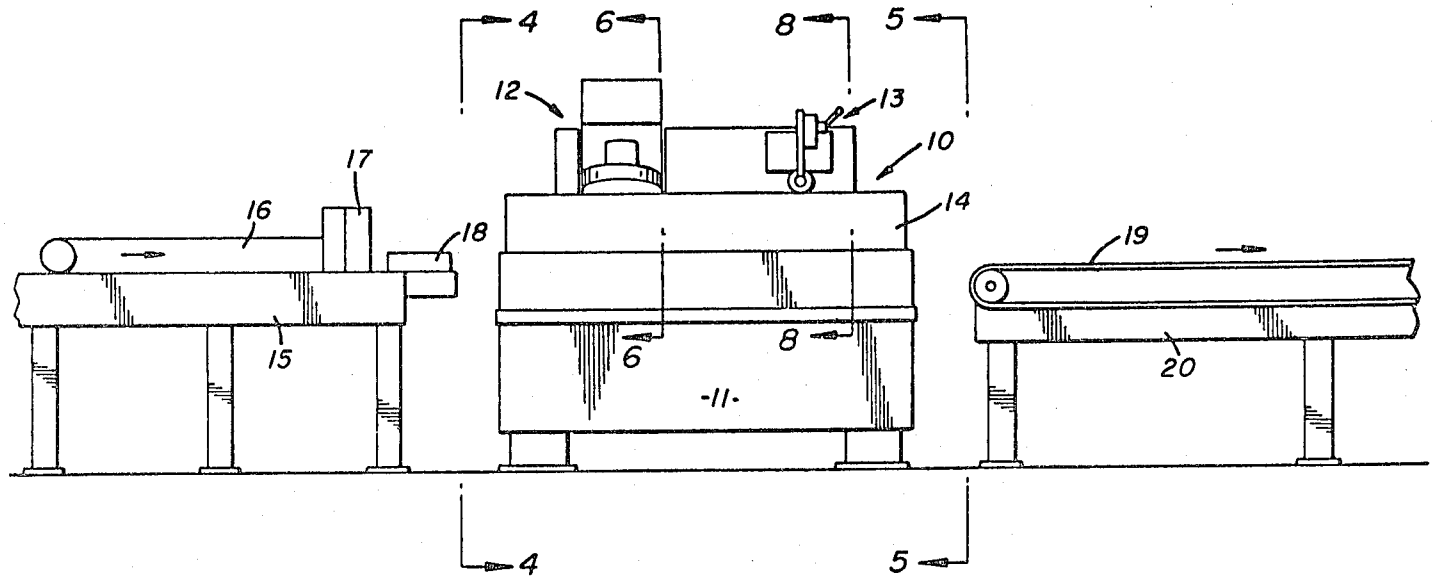
FIG. 1 is a front view of a first oval dish forming machine, positioned between a clay presenting device and a conveyor.

By referring to FIG. 1 of the drawings, it will be seen that the first oval dish forming machine, generally indicated by the numeral 10, comprises a supporting structure 11, and has a spreading station generally indicated at 12 and a finishing station generally indicated at 13. The supporting structure 11 encloses a driving mechanism as hereinafter described which imparts controlled eccentric motion to spindles and wheels located behind a guard 14 of the machine as seen in FIG. 1 of the drawings. At the spreading station 12 the machine comprises means for engaging plastic clay on a porous plaster mould as hereinafter described, and at the finishing station 13 the machine comprises means for engaging the spread clay on its porous plaster mould to finish the same.

In FIG. 1 of the drawings a table 15 is located to the left of the oval dish forming machine 10 and is illustrated as supporting a slug of plastic clay 16. A cut-off device 17 cuts off a disc 18 from the slug 16, which disc is then manually positioned on a mould as hereinafter described. After processing by the forming machine 10 the desirably shaped clay piece on its mould is removed from the finishing station 13 and positioned on a conveyor 19 on a secondary table 20 at the right hand side of the oval dish forming machine 10. The only manual operations are positioning the cut clay disc 18 on the mould at the spreading station 12, moving the spread clay on the mould from the spreading station 12 to the finishing station 13 and finally moving the shaped clay on the mould from the finishing station 13 to the conveyor 19 where the shaped clay still on the mould, moves to its next point of processing (such as drying and/or firing) as will be understood by those skilled in the art.

Figure 2:
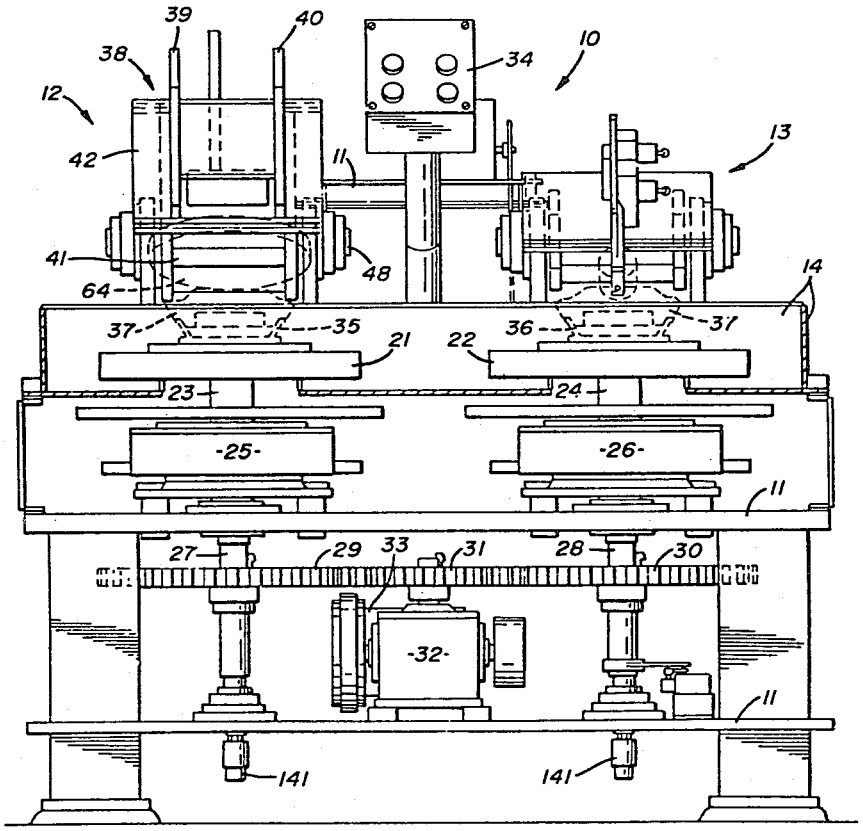
FIG. 2 is an enlarged front view of the forming machine seen in FIG. 1 with operating mechanism being illustrated, broken lines indicating a clay piece on a plaster mould.

By referring now to FIG. 2 of the drawings, an enlarged front detailed view of the oval dish forming machine 10 may be seen in which the front portion of the guard 14 has been removed along with the front panels which normally enclose the driving mechanism and the eccentric motion devices of mould supporting mechanisms of the machine.

In FIG. 2 of the drawings, a pair of wheels 21 and 22 are shown attached to the upper end of spindles 23 and 24 which are supported by, and rotated eccentrically by eccentric motion devices 25 and 26. Driving shafts 27 and 28 impart rotary motion to the eccentric motion devices 25 and 26 respectively and are in turn rotated, for example of 200 rpm, by gears 29 and 30 on the shafts 27 and 28 respectively and engaged with a common gear 31 on a gear box 32 which is driven by an electric motor 33. The motor 33 is controlled by a switch on a switch box 34. Each of the wheels 21 and 22 incorporate vacuum chucks 35 and 36 respectively arranged to receive and hold porous plaster moulds 37 which also serve as carriers for the clay being processed in the oval dish forming machine.

In FIG. 2 of the drawings, the wheel 21 and its vacuum chuck 35 are positioned beneath a tool supporting head (referred to hereinafter as a work head, and generally indicated by the numeral 38) and comprising a pair of arms 39 and 40 which are joined at their outermost ends by a cross piece 41 and at their opposite or innermost ends by a plate 42.

Figure 6:
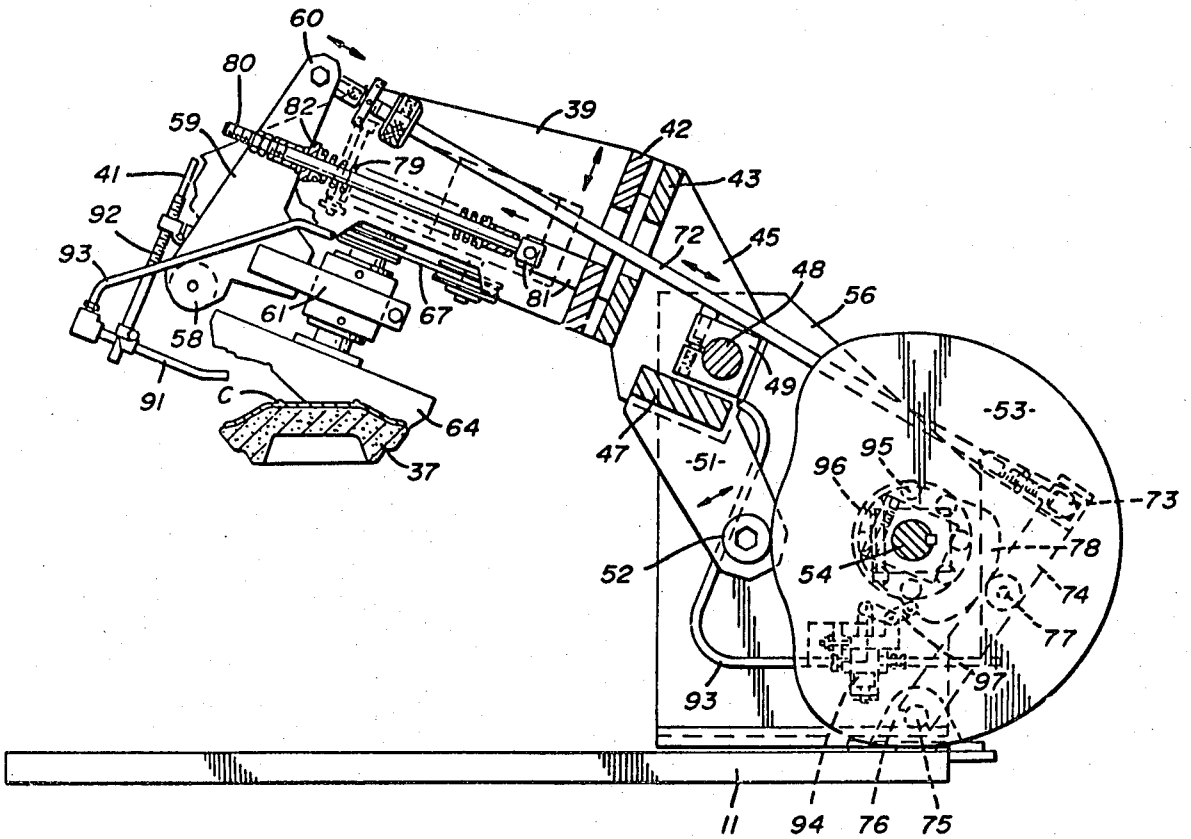
FIG. 6 is a side elevation in enlarged detail with parts broken away and parts in cross-section as taken on line 6—6 of FIG. 1.
Figure 7:
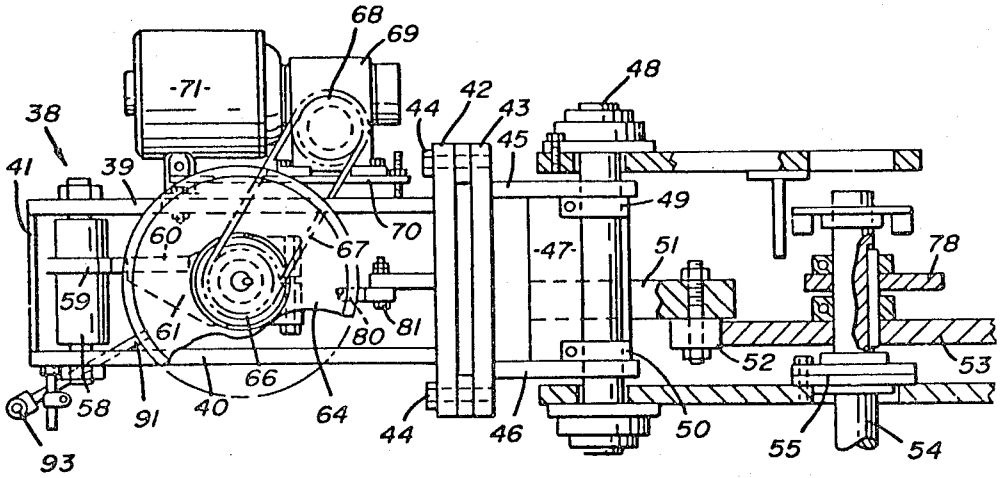
FIG. 7 is a top plan view with parts broken away of a portion of the machine seen in FIG. 6 of the drawings.

By referring now to FIGS. 2, 3, 4 and 7 of the drawings, it will be seen that the plate 42 and the arms 39 and 40 and the cross piece 41 form a subassembly which is fastened to a secondary plate 43 by fasteners 44 as best seen in FIG. 7 of the drawings. A pair of secondary arms 45 and 46 are attached to the secondary plate 43 and extend outwardly and downwardly therefrom as best seen in FIG. 6 of the drawings, and are in turn secured to one another by a secondary cross piece 47 adjacent their lowermost ends. The secondary arms 45 and 46 are apertured so that they can be pivotally mounted on a shaft 48 by means of bearing blocks 49 and 50 secured to the inner sides of the secondary arms 45 and 46. A cam arm 51 extends outwardly and downwardly from the secondary cross piece 47 and has a cam roller 52 thereon which is engaged against the periphery of a cam disc 53 which in turn is mounted on a cam shaft 54 which extends horizontally across the rear portion of the oval dish forming machine and is journalled in bearings 55 transversely of a plurality of upright frame members 56.

By referring now to FIGS. 3,4,6 and 7 of the drawings, it will be seen that the arms 39 and 40 extend outwardly and downwardly from the plate 42 where their outermost ends form a nose 57. A cylindrical member 58 is journalled between the arms 39 and 40 in the nose portion 57 and a rocker arm 59 is attached to the cylindrical member 58 and extends upwardly therefrom to an upper end 60. A secondary rocker arm 61 is secured to the rocker arm 59 and extends inwardly of the nose 57 toward the shaft 48 heretofore described. The secondary rocker arm 61 mounts a bearing cartridge 62 which in turn positions a rotatable shaft 63, the lower end of which carries a pancake-type roller tool 64. The roller tool 64 is hereinafter referred to as a spreading roller. The surface of the spreading roller 64 corresponds with the desired configuration of the bottom of an oval dish to be formed on the machine.

Figure 4:
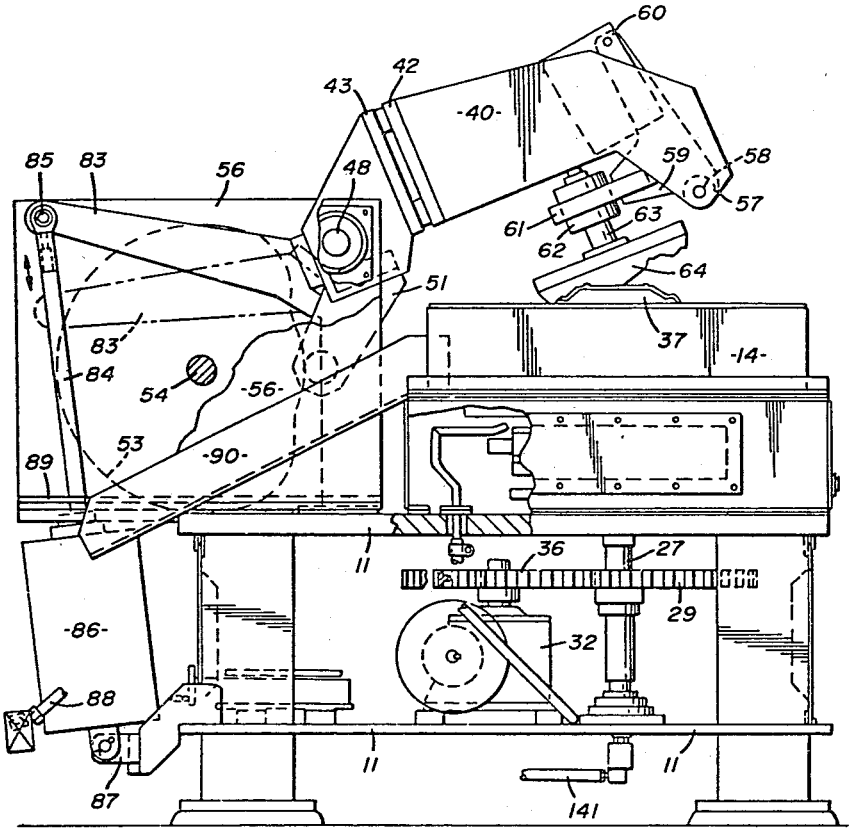
FIG. 4 is a side elevation in enlarged detail taken on line 4—4 of FIG. 1.

In FIGS. 2,4 and 6 of the drawings, the roller 64 is illustrated in partial engagement with clay on a porous plaster mould 37. An enlarged cross-sectional detail of one of the moulds 37 may be seen in the upper portion of FIG. 11.

By referring again to FIGS. 3,4,6 and 7 of the drawings, it will be seen that the rotatable shaft 63 which carries the roller 64 has a pulley 66 on its uppermost end with a belt 67 trained thereover and over a second pulley 68 on a secondary gear box 69 mounted on a support 70 along with a driving electric motor 71. The support 70 is adjustably positioned on the arm 39 of the work head being described. The arrangement is such that energization of the driving electric motor 71, as by one of the switches on the switch box 34, imparts rotation to the roller 64. The rotation of the roller 64 is matched with the rotation of the wheel 21 and spindle 23 which carry the porous plaster mould 37, so that the clay disc becomes spread and initially shaped on the mould.

Figure 3:
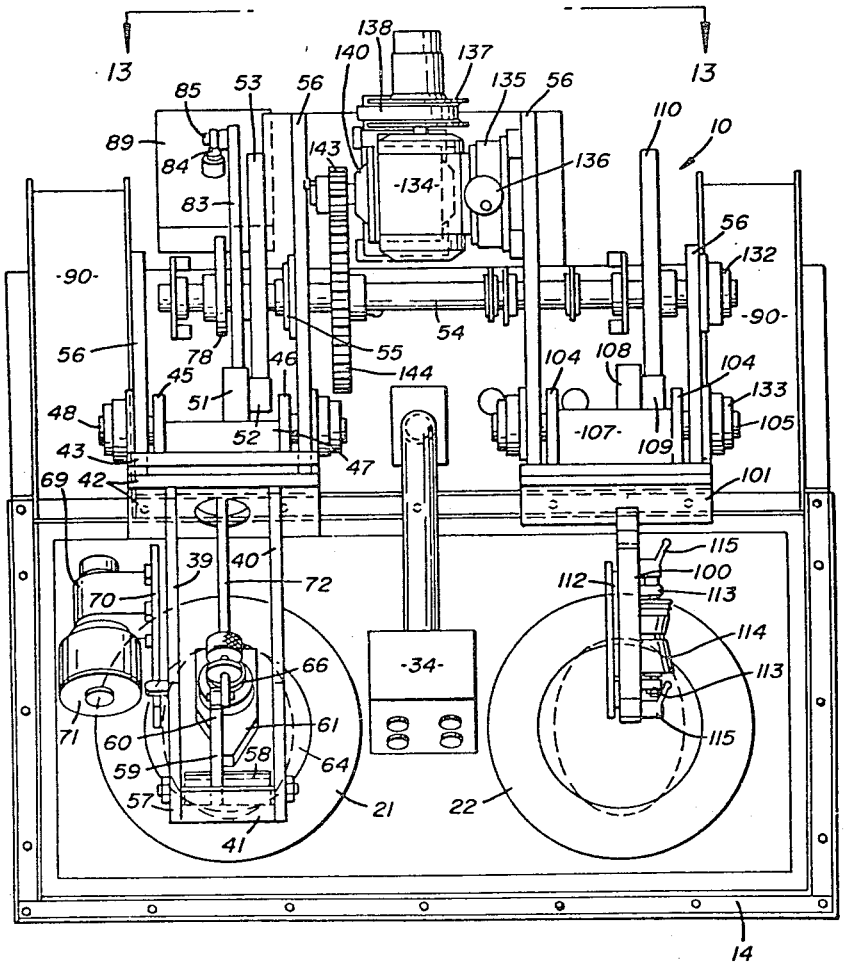
FIG. 3 is a top plan view of the machine seen in FIG. 2.

By referring now to FIGS. 3 and 6 in particular, it will be seen that the upper end 60 of the rocker arm 59 is adjustably and movably attached to one end of a rod 72 which extends inwardly therefrom through apertures in the plates 42 and 43 to a pivotal attachment 73 on the upper end of a secondary rocker arm 74, the lower end of which is pivoted as at 75 to a bracket 76 on a portion of the supporting structure 11. A secondary cam roller 77 on the secondary rocker arm 74 is positioned for engagement with a secondary cam 78 on the cam shaft 54.

Tensioning means is provided to insure the retention of the secondary cam roller 77 against the secondary cam 78 and comprises a coil spring 79 positioned on a rod 80, one end 81 of which is affixed to the plate 42 and the other end of which is adjustably attached by a fitting 82 to the rocker arm 59.

The work head just described, located at the spreading station of the oval dish forming machine, will thus be seen to position the roller 64 against the clay to be initially shaped thereby whilst the clay on its supporting plaster mould 37 is revolved in an eccentric motion therebeneath. The work head of the spreading station causes the roller 64 to engage the clay on one side of the eccentric pattern which the clay is following, as will be understood by those skilled in the art.

More importantly the work head moves the roller 64 against the clay in a desirable pressuring action as predetermined by the shape of the cam disc 53, while simultaneously rocking the roller 64 as a result of the rocking action imparted thereto by the rocker arm 59 and its motion originated by the secondary cam 78.

As hereinbefore described, the combination of the controlled pressure application of the roller 64 to the clay and the rocking motion of the roller 64 result in the very desirable shaping of the clay with results equal to or better than the best manual shaping by a skilled potter.

It will occur to those skilled in the art that the plasticity of the clay being worked may vary, as may the shape and thickness of the disc 18 being intially shaped by the roller 64, and in order to add desirable additional pressure as exerted by the roller 64 on the clay on its plaster mould an auxiliary tensioning device is incorporated in the spreading station work head.

In FIGS. 3 and 4 of the drawings, the auxiliary tensioning device may be seen to comprise a tensioning arm 83 attached at its inner end to the cam arm 51 and extending rearwardly therefrom, to the left in FIG. 4, the tensioning arm 83 is pivoted at its outer end to a piston rod 84 by a pivot 85. The piston rod 84 extends downwardly and into a pneumatic piston and cylinder assembly 86 which is movably mounted at its lower end on a bracket 87 on the structural support 11. Flexible air hoses 88 extend to a valve controlled source of compressed air, the valves being actuated by cams on the cam shaft 54 so that air pressure delivered to the lower end of the cylinder 86 will move the piston therein and the piston rod 84 upwardly along with the tensioning arm 83 and thereby add downward directed tension to the work head and the roller 64 carried thereby.

In FIG. 3 of the drawings, the upper end of the pneumatic cylinder 86 is covered by a shield 89 which is part of the housing generally enclosing the device to protect the mechanism thereof from the clay spun off and discarded at the spreading and finishing stations of the machine.

In FIGS. 3 and 4 of the drawings, disposal chutes 90 may be seen extending from the area of the wheels 21 and within the guards 14. Those skilled in the art will recognise that lubrication of the clay during its forming and shaping may be required, and in FIG. 6 of the drawings a nozzle 91 is provided on an adjustable support 92, the nozzle being in communication with a tube 93 which extends to a source of lubricant, such as oil, under pressure which is controlled by a valve 94 in a series of alternate on/off actions which are originated by buttons 95 on a disc 96 on the cam shaft 54 which are arranged to engage and release a valve actuating lever 97.

When the clay on its plaster mould 37 is shaped after the desired number of revolutions on the wheel 21, the machine stops the rotation of the wheels 21 and 22 and the roller 64 by reason of cam controlled switches actuated by the cam shaft 54 and appropriately shaped cams thereon. Simultaneously the work head carrying the roller 64 moves upwardly to a location spaced above the shaped clay on its plaster mould 37, as does the similar work head of the finishing station 13 heretofore referred to. The operator then manually removes the mould 37 with the clay thereon and positions this on the vacuum chuck 36 of the wheel 22 and adds a new plaster mould 37 with a new piece of plastic clay to the wheel 21 at the spreading station 12. The machine may be arranged to automatically start its recycling or it may be manually controlled by a switch on the switch box 34. In the latter event, which is preferable, the operator then starts the machine whereupon the hereinbefore described cycle of the work head carrying the roller 64 is repeated while simultaneously the finishing station work head seen at the right hand side of FIGS. 2 and 3, begins its cam controlled cycle wherein the clay shape is finished.

In FIGS. 2,3,5,8 and 9 of the drawings, the details of the finishing station may be seen to comprise a support arm 100 which extends outwardly over the wheel 22 and is carried by a third plate 101 which in turn is attached to a fourth plate 102 by fasteners 103. A pair of secondary support arms 104 are attached to the fourth plate 102 and extend inwardly therefrom and are apertured for pivotal engagement about a pivot shaft 105. Bearing blocks 106 on the inner sides of the secondary support arms 104 are provided. A secondary cross piece 107 extends between the secondary support arms 104 and has a secondary cam arm 108 secured thereto which extends downwardly and rearwardly with respect to the secondary support shaft 105. A cam roller 109 on the secondary cam arm 108 is engaged against the periphery of a support arm actuating cam disc 110 which is secured to the cam shaft 54 heretofore referred to.

By referring again to the support arm 100, it will be seen that it adjustably mounts a support arm plate 112, the lower end of which has spaced apertured brackets 113 thereon which are arranged to receive extending end shafts of a dumb-bell shaped roller tool 114. The roller tool 114 is hereinafter referred to as a finishing roller.

Figure 5:
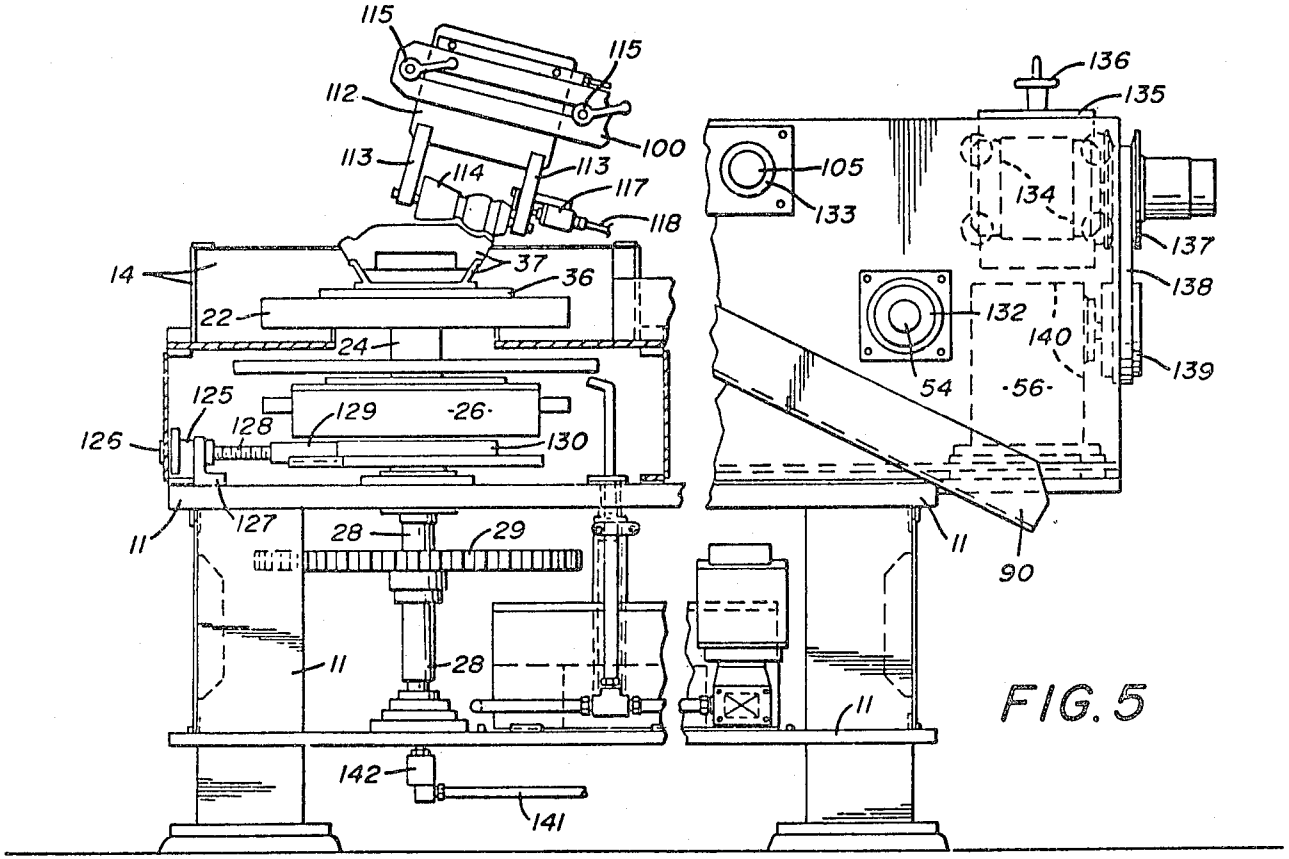
FIG. 5 is a side elevation in enlarged detail taken on line 5—5 of FIG. 1.
Figure 8:
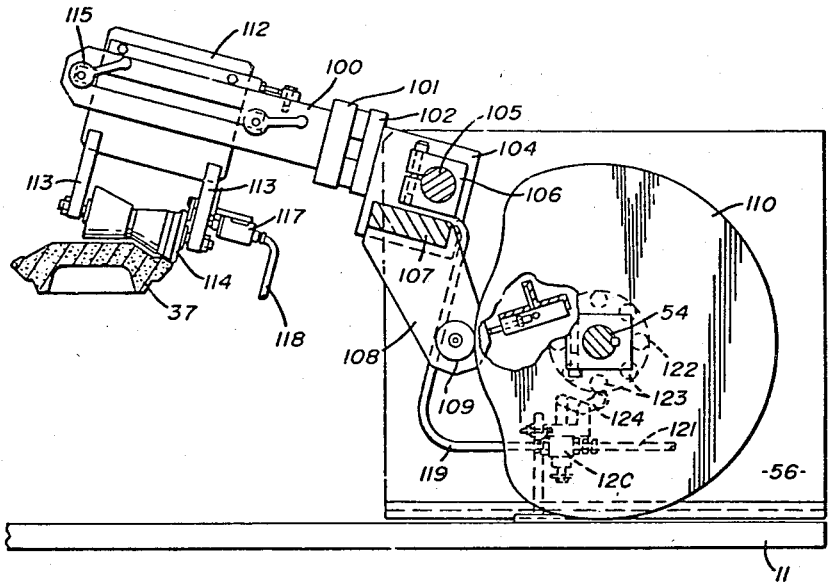
FIG. 8 is an enlarged detailed side elevation with parts broken away illustrating a portion of the machine seen in FIG. 5 of the drawings as taken on line 8—8 of FIG. 1.
Figure 9:
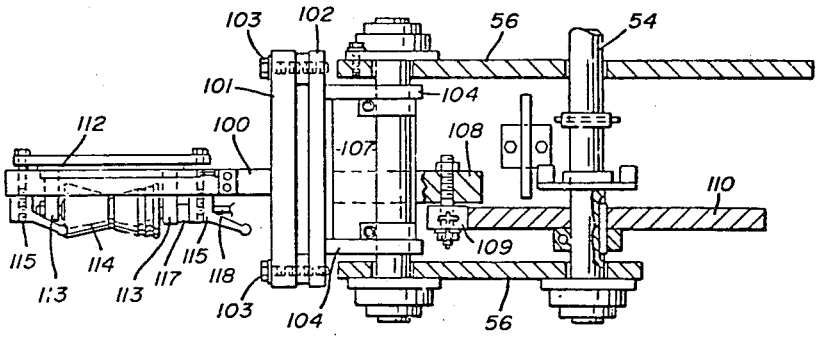
FIG. 9 is a top plan view with parts in cross-section and parts broken away illustrating the portion of the machine seen in FIG. 8 of the drawings.

In FIGS. 2,5 and 8 of the drawings, the finishing roller 114 is seen in operative relation to a porous plaster mould 37 on which a spread clay shape, is positioned.

The support arm plate 112 is adjustably positioned on the support arm 100 by a pair of manually operable fasteners 115 which are engaged in the plate 112 and extend through a slot in the support arm 100. The arrangement is such that the vertically positioned support arm plate and its depending brackets 113 which mount the roller 114 can be adjustably positioned and/or replaced on the support arm 100.

By referring now to FIG. 8 of the drawings in particular, it will be seen that an air actuated brake 117 is mounted on one of the brackets 113 and connected to an air supply source by a flexible air supply tube 118. The air supply source may comprise an air pump operated by an electric motor and a valve controls the air pressure communicating with the tube 118 and the valve is actuated by an air control cam on the cam shaft 54, the arrangement being such that when the finishing cycle is substantially completed, such as just prior to the last revolution of the wheel 22, the air brake 117 is actuated to stop the otherwise free rotation of the dumb-bell shaped finishing roller 114 whereupon it slides on the finished clay shape and provides a smooth finished surface.

Those skilled in the art will observe that lubrication may be necessary in this finishing operation and a lubricant supply line 119 leads to a nozzle positioned for directing lubricant on the clay shape adjacent the finishing roller 114. The lubricant supply line 119 is controlled by a valve 120 which communicates with the lubricatant supply source heretofore referred to as by a lubricant line 221. A lubricant control disc 122 on the cam shaft 54 is provided with a plurality of buttons 123 which are positioned for engagement with an actuating lever 124 by means of which the valve 120 is alternately opened and closed.

In FIG. 5 of the drawings, the support arm 100, the support arm plate 112 and the roller 117 are shown in working position relative to the clay on the plaster mould 37 which in turn is located on the wheel 22 on the spindle 24. The eccentric motion imparting device 26 is shown with an adjustment device 125 engaged thereagainst which device comprises a wrench receiving socket 126 rotatably positioned in a bearing support 127 and attached to a threaded screw 128. The screw 128 is therefore revolvable by a wrench engaged in the socket 126. The opposite end of the screw 128 is engaged in a follower 129 which is attached to a member 130 which is thereby movable toward and away from the spindle 28 so that the desired degree of eccentricity to be imparted to the spindle 24 may be realized. The eccentric motion device 26 is further illustrated and described in connection with FIGS. 10, 11 and 12 of the drawings.

Still referring to FIG. 5 of the drawings, parts of which are broken away, it will be seen that the vertical support member 56 is illustrated as positioning bearing enclosures 132 and 133 respectively, which journal the ends of the cam shaft 54 and the secondary support shaft 105 respectively. Broken lines in FIG. 5 illustrate an electric motor 134 which is mounted on a vertically slidable member 135 and which is adjustable vertically by a manual handle 136 (see also FIGS. 3 and 13). The motor 134 drives a pulley 137 over which a belt 138 is trained and by which motion is imparted to a second pulley 139 on a gear reduction box 140 which is provided for driving the cam shaft 54 which is positioned adjacent thereto as best seen in FIGS. 3 and 13.

In FIG. 5 a vacuum line 141 is shown in communication with a fitting 142 which communicates with the interior of the spindle 28.

Figure 13:
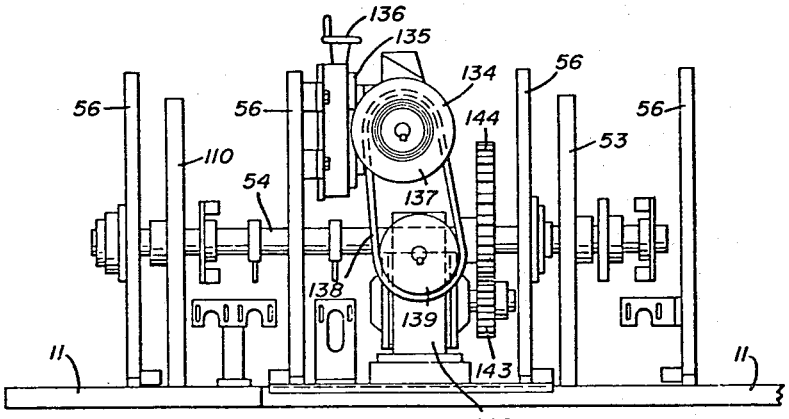
FIG. 13 is an elevation of driving mechanism for roller tools used at the spreading and finishing stations of the oval dish forming machine.

By referring now to FIGS. 3 and 13, it will be seen that the gear box 140 drives a gear 143 which is engaged with a second gear 144 which is keyed to the cam shaft 54.

Figure 10:
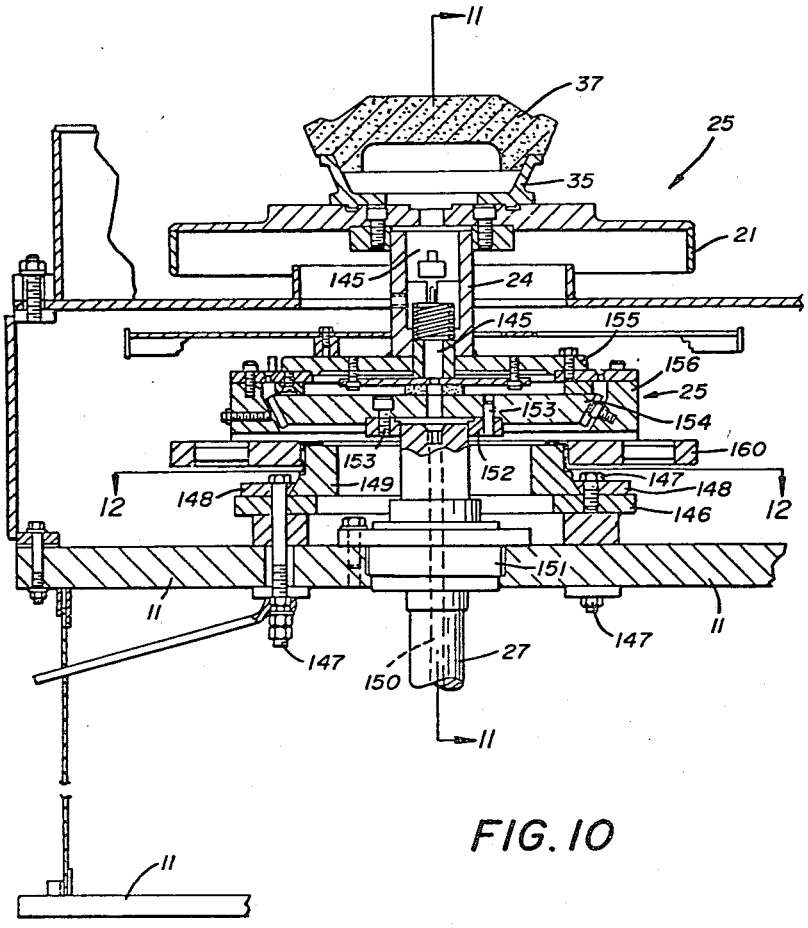
FIG. 10 is an enlarged detail of a front elevation wit parts broken away and parts in cross-section showing one of the eccentric motion devices of mould supporting mechanisms at spreading and finishing stations of the machine.
Figure 11:
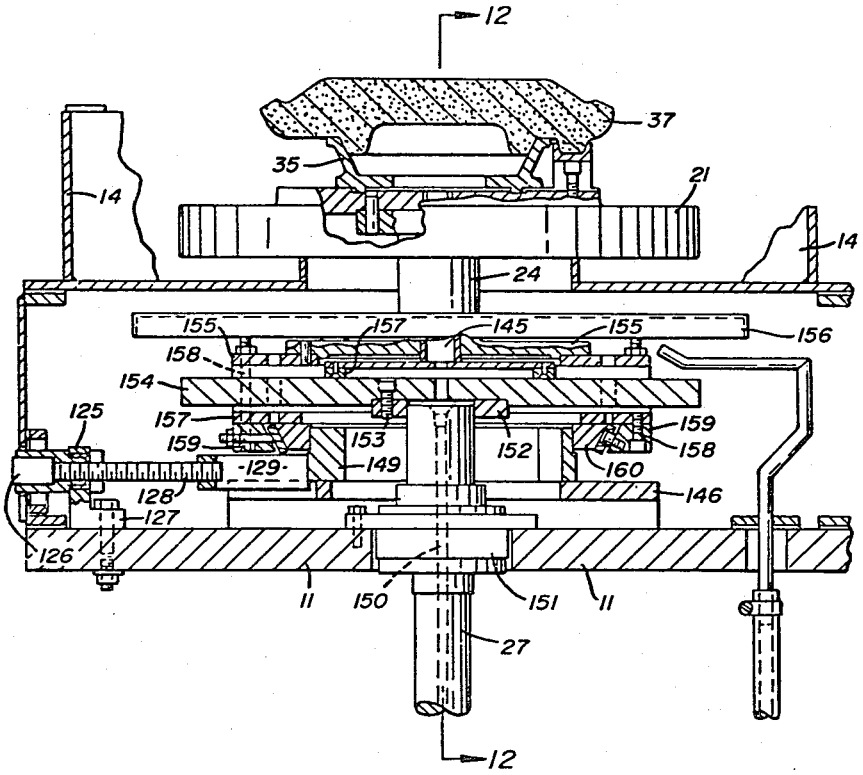
FIG. 11 is a view of the eccentric motion device of FIG. 10 shown in side elevation with parts broken away and parts in cross-section.
Figure 12:
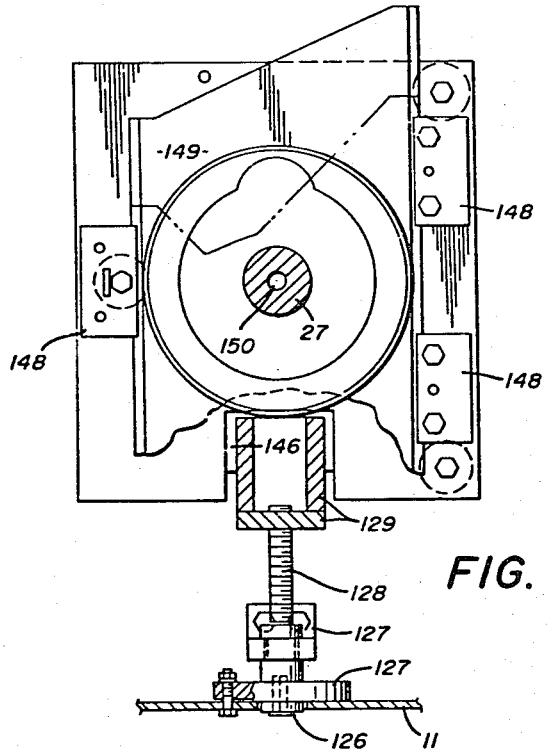
FIG. 12 is a top plan view with parts broken away of the eccentric motion device of FIG. 10.

By referring now to FIGS. 10 and 11 of the drawings, details of one of the eccentric motion devies 25 and 26 may be seen. In FIG. 10 a vertical section through the machine and the wheel 21 illustrates the uppermost surface thereof supporting the vacuum chuck 35 and one of the porous plaster moulds 37. An opening in the center of the wheel 21 communicates with the interior of the vacuum chuck 35 and the interior of the spindle 24 is hollow to form a passageway 145 downwardly therethrough. The eccentric motion device 25 comprises an apertured frame 146 fastened to a portion of the support structure 11 by fasteners 147. Tapered parallel guides 148 are also attached to the apertured frame 146 by the fasteners 147 so as to slidably position a hollow body member 149. The spindle 27, which drives the eccentric motion device 25 and the wheel 21, has an axial passageway 150 longitudinally thereof and a bearing assembly 151 positions the spindle 27 in an opening in the supporting structure 11. A collar 152 is affixed to the upper end of the spindle 27 and fasteners 153 secure a driver slide 154 to the collar 152 so that rotary motion of the spindle 27 will be imparted to the driver slide 154. A top slide piece 155 is attached to the bottom of the spindle 24 which carries the wheel 21 and angular depending guides 156 on the edges of the top slide piece 155 partially underlie tapered edges on the driver slide 154 as best seen in FIG. 10 of the drawings.

By referring now to FIG. 11 of the drawings, it will be seen that an intermediate plate 157 is attached to the top slide piece 155 by fasteners 158 and that a pair of spaced parallel secondary angular guides 159 are positioned beneath the opposite ends of the flat plate 157 with their angular opposed surfaces extending inwardly and downwardly where they position a bottom slide piece 160 for reciprocal motion at right angles to the reciprocal motion of the top slide piece 155. The bottom slide piece 160 has a large opening therein which is in registry with the outer circular upper portion of the body member 149 heretofore referred to.

It will thus be seen that rotary motion of the spindle 27 on a fixed vertical axis rotates the driver slide 154, which is secured to the spindle 27 by way of collar 152. The top slide piece 155 slidably engaging the opposite longitudinal edges of the driver slide 154, spins with the driver slide 154 and centrifugal motion moves the top slide 154 piece relative to the driver slide 54 as permitted by the positioning of the body member 149 so that a desired eccentric motion of the spindle 24, the wheel 21 and the vacuum chuck 35 are obtained. The clay shape on the porous plaster mould 37 thus oscillates in an oval pattern as illustrated in broken lines in FIG. 3 of the drawings.

The engagement of the clay in the spreading station 12 by the spreading roller 64 results in the desired spreading and shaping of the clay as the clay is formed into an oval shape by the eccentric travel of the oscillating revolving wheel 21, and the same oscillating revolving motion of the wheel 22 enables the finishing roller 114 to similarly shape and smooth the oval dish being formed by the oval dish forming machine.

As hereinbefore described, the vacuum chucks which hold the porous plaster moulds 37 on each of the wheels 21 and 22 during the simultaneous spreading and finishing actions of the spreading and finishing stages of the machine, are actuated by the communication of the vacuum line with the passageways axially of the spindles 27 and 28. The vacuum is conveyed through the eccentric motion devices as illustrated in FIGS. 10 and 11 of the drawings, and by referring to FIG. 11 it will be observed that the upper end of the axial passageway 150 in the spindle 27 communicates with the interior of the collar 152 and through an opening in the driver slide 154. The top slide piece 155, being movable in a reciprocal motion relative to the driver slide 154, is provided with a sealing member 161 which forms a closure with respect to the middle portion of the top slide piece 155 and the area of the driver slide 154 about the opening therein. The vacuum thus communicates with the passageway 145 within the spindle 24 and with the vacuum chuck 35 by way of the opening in the center of the wheel 21 as hereinbefore described. The vacuum lines which communicate with the spindles 27 and 28 are shown in FIG. 2 of the drawings and are indicated by the numeral 141. They extend to a suitable vacuum (below atmospheric pressure) source.

It will be seen that although the first oval dish forming machine described has a common drive means for the spreading and finishing stations, these may be individually driven if desired so long as they are appropriately controlled.

The second machine (see FIGS. 14 to 18) comprises two similar making units 200 and 202 comprising very robust frameworks 204 and 206, the two frameworks being bolted together to form a single machine.

Figure 17:
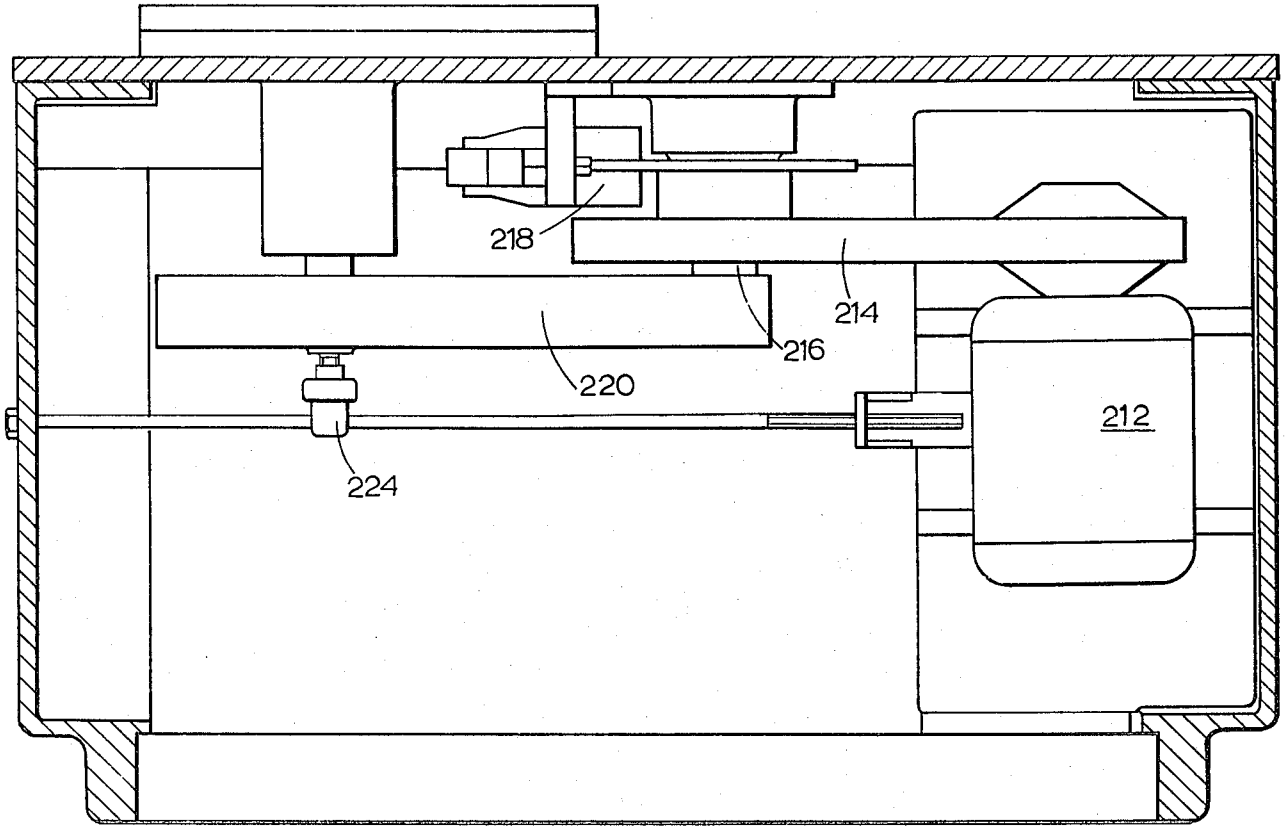
FIG. 17 shows a driving mechanism for a mould supporting mechanism of the machine.
Figure 18:
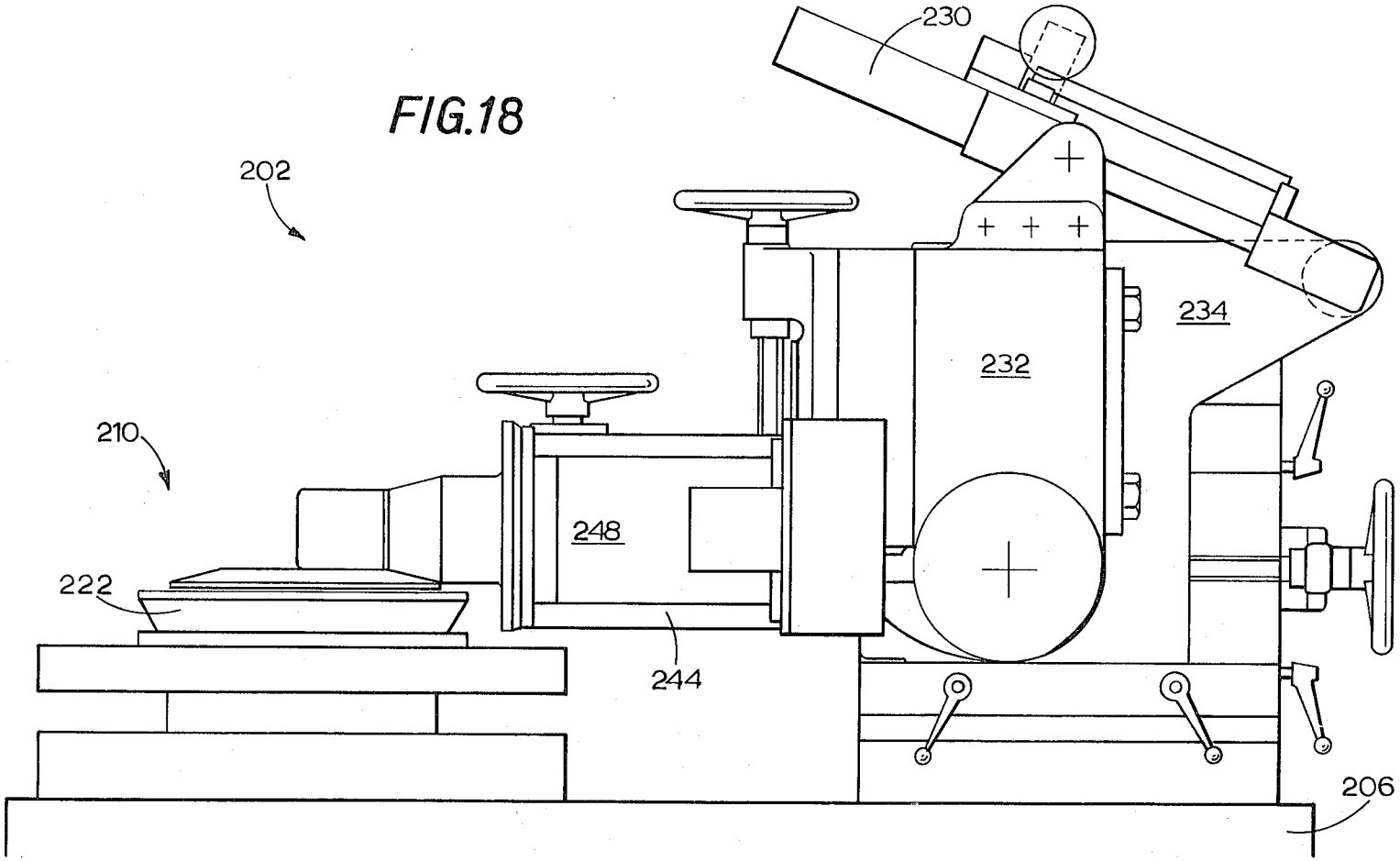
FIG. 18 is a view similar to FIG. 16 but showing the use of an alternative finishing tool.

The units 200 and 202 comprise mould supporting mechanisms 208 and 210 by which moulds can be rotated eccentrically; the mechanism by which the eccentric motion is achieved is similar to that of the first machine. As seen in FIG. 17, a driving mechanism for each of the mould supporting mechanisms comprises an electric motor 212 of a star-delta winding type, and an infinitely variable speed vee belt drive 214 driving an intermediate spindle 216. A pneumatically operated disc brake 218 operates on the intermediate spindle 216. A further belt 220 transmits drive from the intermediate spindle 216 to a drive shaft of the mould supporting mechanism; the drive shaft is connected to an oval mould support chuck 222 see FIG. 15 through mechanism which produces an elliptical motion of the chuck, revolving a porous mould on the chuck in such a way that the rear of the mould revolves past a fixed line. The drive shaft is also fitted with a rotary vacuum connection 224 through which vacuum can be applied to the underside of a mould on the support chuck 222; see FIG. 15 the vacuum can serve both to hold the mould down in its chuck and, acting through the porous mould, to hold down clay on the mould and so reduce slipping and stretching of the clay and avoid air entrapment.

The degree of ovality, i.e. the difference between the major and minor radii of the oval ware, can be adjusted by means of an adjusting screw (not shown) of the mould supporting mechanism.

Figure 14:
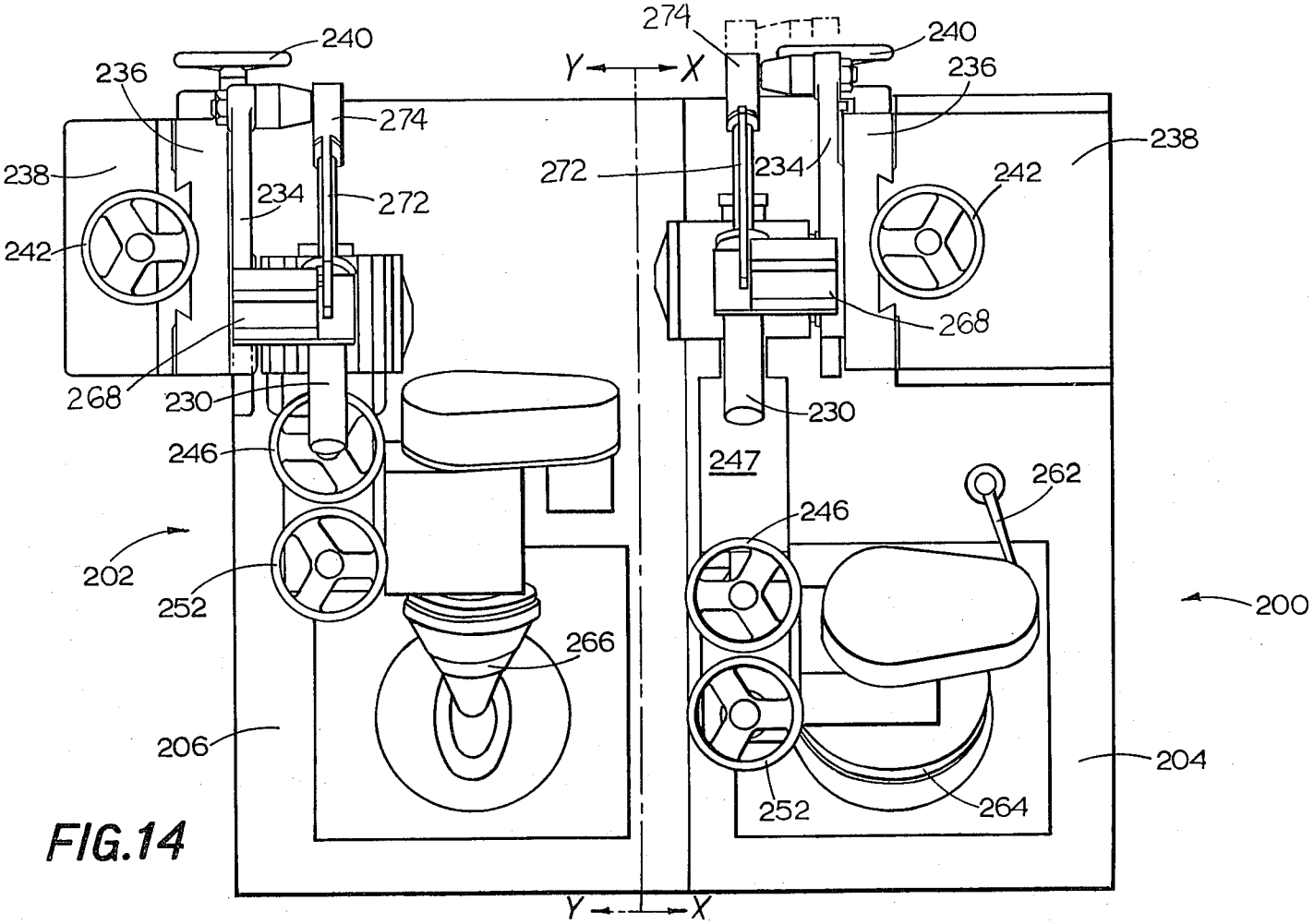
FIG. 14 is a plan view of the second oval dish forming machine.
Figure 15:
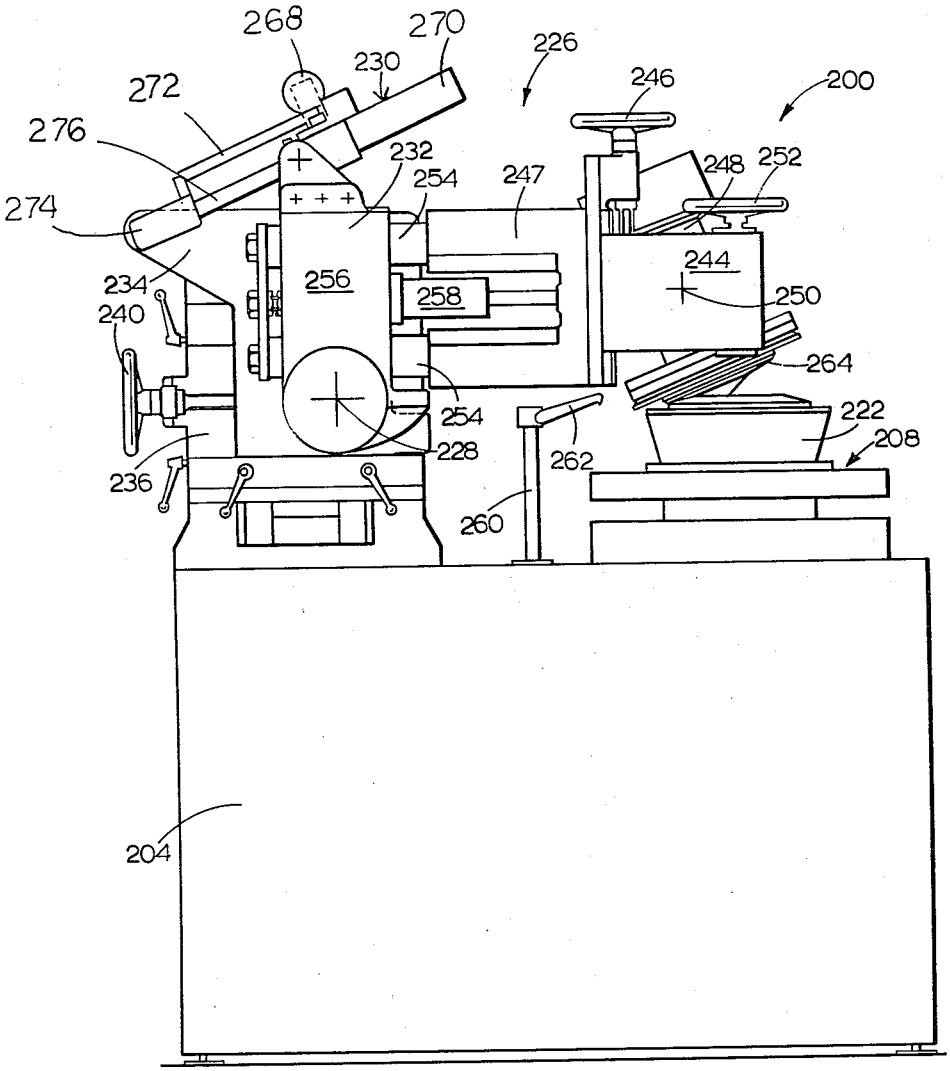
FIG. 15 is a view on section X—X of FIG. 14.
Figure 16:
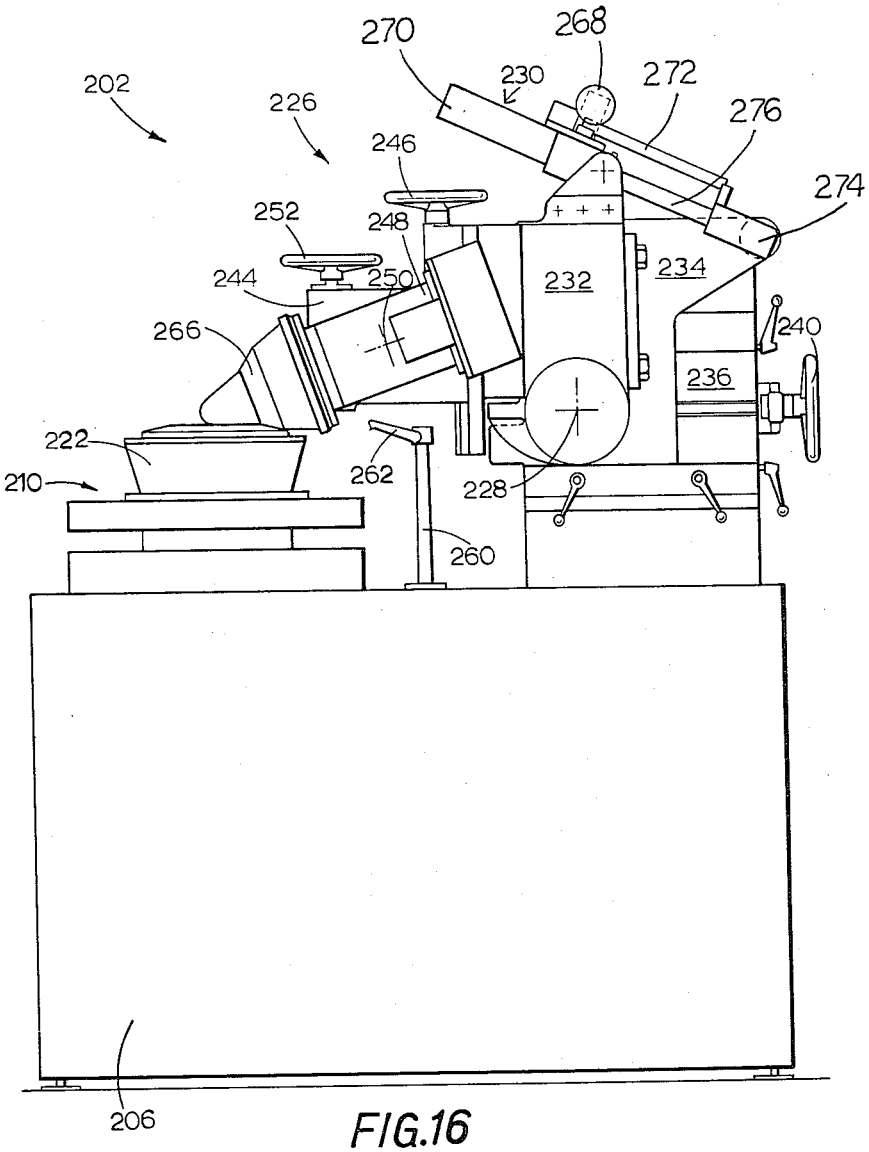
FIG. 16 is a view on section Y—Y of FIG. 14.

Each of the making units 200 and 202 comprises a tool supporting head 226. The two tool supporting heads 226 are of similar construction. As shown in FIGS. 14 to 16, each head 226 is pivotally mounted to rock about a horizontal axis 228 under the control of a hydraulic driving unit 230. Each head 226 comprises a rocking arm 232 mounted to pivot about the axis 228 on a supporting member 234; the driving unit 230 is pivotally mounted on the supporting member 234 to act between the member 234 and the arm 232. The supporting member 234 is mounted by means of a slide 236 on a base 238, secured to the framework 204 or 206 of the unit, for horizontal and vertical adjustment of the position of the pivot arms 228; the supporting member 234 is slidably mounted on the slide 236 for horizontal movements (relative to the slide) under the control of a handwheel 240, and the slide 236 is itself slidably mounted on the base 238 for vertical movements (relative to the base) under the control of a handwheel 242.

A tool post 244 is slidably mounted on the arm 232 of each tool supporting head 226 for vertical movements (relative to the arm) under the control of a handwheel 246. A tool carrier 248 is pivotally mounted on the post 244 for movements about a horizontal axis 250 under the control of a handwheel 252.

One difference in construction between the rocking arms 232 of the two making units is to be observed. In a first of the two making units, the unit 200 (see FIG. 15), the arm 232 comprises a spacer 247 which is secured to two slide bars 254 which are slidably mounted in bores in a bearing portion 256 of the arm, so that the length of the arm can be changed by a small amount by movement of the spacer 247 relative to the bearing portion 256. A hydraulic cylinder 258 is arranged to effect adjustment of the length of the arm. Owing to the spacer 247, even with the arm 232 fully contracted it is longer than the arm of the second making unit 202, to suit the kind of tool to be mounted on that head.

Each of the tool carriers 248 is arranged to support a roller shaping tool for rotation about its axis, and comprises a hydraulic motor for rotation of the tool at a predetermined speed. Means for varying the speed of rotation of the tool is provided, so that the tool can be rotated at a suitable speed for any particular ware-making operation. Electrical heating means is also provided, which also is adjustable, for heating the tool to a required working temperature.

Each of the making units 200 and 202 comprises a trimming device comprising an upstanding post 260 on which a trimming blade 262 is pivotally mounted. The blade can be swung (by means not shown) to trim the periphery of a piece of clay on a rotating mould on the mould supporting mechanism.

As with the first forming machine, hereinbefore described, the first unit 200 is for use in a first stage of ware forming, in which a disc of clay is spread and preformed on a mould, and the second unit 202 is for use in a second stage in which the preformed clay is finished on its mould to the required shape. For the first stage, a spreading tool in the form of a so-called pancake-type tool 264 (FIG. 15) is mounted on the tool supporting head 226 of the first making unit 200; the tool is mounted with its axis of rotation at an angle of $17\frac{1}{2}°$ to the axis of rotation of the mould. For the second stage, a finishing tool in the form of a conical tool 266 (FIG. 16) is mounted on the head 226 of the second making unit 202; the tool is mounted with its axis of rotation at 19° to a radius from the axis of rotation of the mould. For the second stage there might alternatively be used a dumb-bell type of tool, similar to the tool 114 of the first machine, or a cylindrical tool of the kind shown in FIG. 18 (with its axis of rotation co-axial with a radius from the axis of rotation of the mould). The kind of tool selected will depend upon the precise form of the ware being produced.

Figure 19:
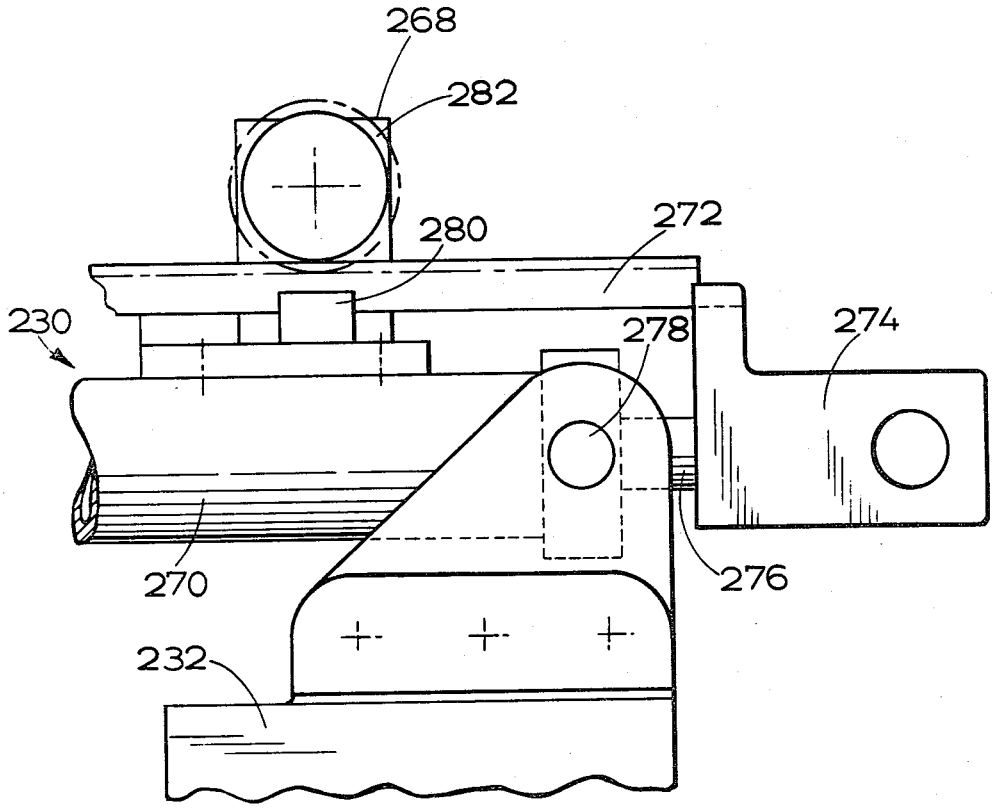
FIG. 19 shows to a larger scale the association of a hydraulic driving unit, of the second machine, with a sequence control switch unit.

Each of the two hydraulic driving units 230, which are arranged to rock the tool supporting heads 226 about the horizontal axes 228, is arranged as shown in FIG. 19 to actuate microswitches of a sequence control switch unit 268. The switch unit 268 is mounted on a cylinder 270 of the driving unit 230. A toothed rack 272 extends parallel to the axis of the cylinder 270 and has one end secured to a bracket 274 which is secured to a piston rod 276 of the driving unit; with regard also to FIGS. 14 to 16, the bracket 274 is pivotally mounted on the supporting member 234 and the cylinder 270 is pivotally mounted on the rocking arm 232 by means of trunnions 278, in order that the driving unit 230 can act between the member 234 and the arm 232 to rock the arm as hereinbefore referred to.

With regard to FIG. 19, the rack 272 is slidably supported by a block 280 on the cylinder 270 and is engaged with a pinion 282 secured to a spindle of the switch unit 268, in order that the spindle be rotated with movement of the rack upon operation of the driving unit. The switch unit 268 is of a conventional kind comprising a plurality of cams mounted on the switch spindle to actuate the microswitches of the unit in a predetermined sequence upon rotation of the spindle.

Figure 20:
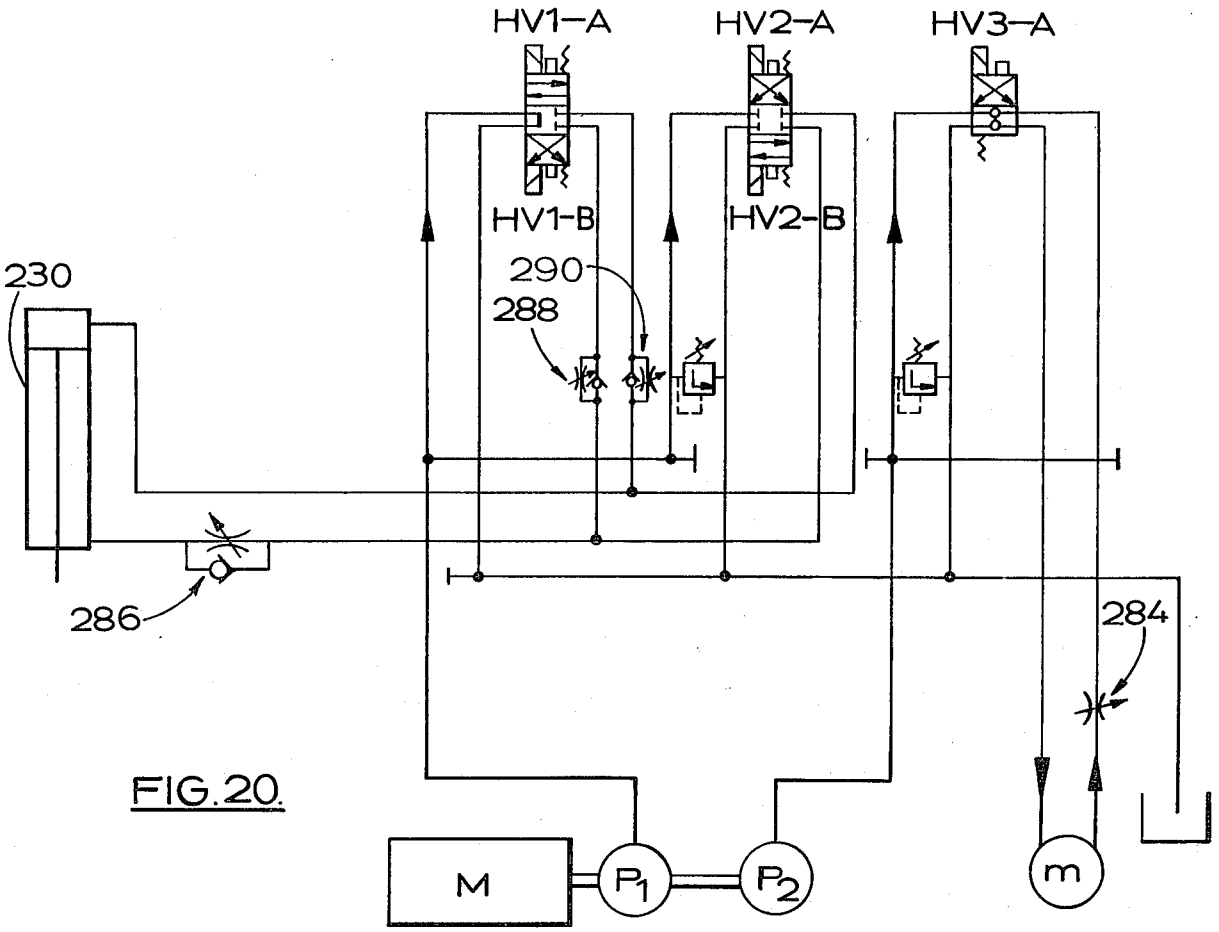
FIG. 20 is a simplified diagram of a hydraulic circuit for operation of the hydraulic driving unit.

A simplified hydraulic circuit, for operation of one of the hydraulic driving units 230, is shown in FIG. 20. An electric motor M drives two pumps $P_1$ and $P_2$ to provide two hydraulic pressure supplies, the pump $P_1$ supplying fluid under pressure for operation of the driving unit 230 and the pump $P_2$ supplying fluid under pressure for operation of the hydraulic motor m for rotation of the roller shaping tool.

Operation of the second forming machine is as follows. An oval dish mould, for example of plaster of Paris, is placed on the chuck 222 of the first unit 200. A disc of clay (which is preferably oval) is placed on the mould. Vacuum is applied to the underside of the mould. Valve HV3-A is energised to commence rotation of the roller tool 264, the tool rotating at a predetermined fixed speed as set by means of a speed regulator 284. The roller tool is maintained at its required operating temperature, by the electrical heating element. Upon energising valves HV1-A and HV2-B, fluid is supplied to the hydraulic driving unit 230 to cause the tool supporting head 226 to be rocked to bring the spreading tool 264 down towards the clay on the mould on the mould supporting mechanism 208. The tool 264 is brought down at a fast speed determined by a regulator 286. With operation of the driving unit 230, movement of the rack 272 relative to the switch unit 268 causes the switch spindle to be rotated. At a predetermined position of the tool 264 just above the clay, a switch of the unit 268 causes valve HV2-B to be closed so that the downward speed is reduced to a suitable speed for clay spreading; the downwards speed is, after closure of valve HV2-B, determined by a regulator 288.

Rotation of the mould by the mould supporting mechanism 208 has meanwhile been started, with the motor 212 in its star winding condition to rotate the mould at a slow speed. The tool 264 makes contact with the clay disc on the mould and begins to roll it out. At a preselected point in the rolling out of the clay (e.g. when the clay has just spread over the "ball" of the dish mould) the motor is changed over to its delta winding condition so as to rotate the mould at a higher speed. Operation of the motor 212 can also be controlled by the switch unit 268.

As the roller tool 264 approaches the end of its stroke, its speed of approach towards the mould is slowed by cushioning built into the hydraulic driving unit 230. At the end of its stroke a switch of the unit 268 causes a timer to be started to cause the tool to dwell for a predetermined time (usually for from one to three seconds). At the end of this dwell period, valve HV1 is reversed to cause the hydraulic driving unit 230 to rock the tool supporting head 226 to lift the roller tool 264 away from the mould, initially at a slow speed controlled by a regulator 290 and thereafter, when valve HV2-A has been opened by the switch unit, at a fast speed. A further switch of the unit 268 closes the valves HV1 and HV2 to stop the driving unit 230 when the tool is at a suitable height above the mould to allow an operator access for changing the mould.

Should it be desirable for certain applications, the spreading tool 264 can be moved, during shaping of the clay, a short distance (i.e. not more than about 1 mm) horizontally across the mould by means of the hydraulic cylinder 258. By this means extra work can be given to the sloping sides of the dish being formed.

The trimming tool 262 is then swung inwards, for about one revolution of the mould, to trim the periphery of the preformed clay piece.

The mould driving motor 212 is then switched off and the spindle brake 218 applied to arrest rotation of the mould. The vacuum beneath the mould is released.

Operation of the hydraulic cylinder 258, the trimming tool 262, the spindle brake 218 and the vacuum can all be controlled by the switch unit 268.

The mould, with the preformed clay piece on it, is then transferred from the chuck 222 of the first making unit 200 to the chuck of the second making unit 202 for a finishing operation by the finishing tool 266. The two making units operate in step with one another so that the first unit 200 effects a spreading operation on one mould while the second unit 202 effects a finishing operation on another.

In working the clay, the roller tools 264 and 266 are each rotated at a speed such that there is some slip between the surface of the tool and the clay beneath. It is preferred that the tools rotate at speeds slightly less than that required for zero slip. Particularly with the finishing tool 266, the slip is useful in giving the clay a better surface finish, reducing pick-up of clay on to the tool, and stressing the surface of the clay in a generally desirable manner.

Where it is desired to form a "foot" on the dish (i.e. in the form of a continuous raised bead around the bottom of the dish) this can be achieved by means of a circumferential groove in the finishing tool 266. The spreading tool 264 may also be grooved to commence formation of the foot, but it may be found that the spreading tool, owing to its flat attitude to the clay, which means that a large amount of its surface is in close proximity to the clay, cannot properly form a foot. A dumb-bell type of finishing tool may be found most suitable where a steep-sided foot is to be formed.

What I claim is:

1. A machine for forming oval flatware in the manufacture of ceramic ware comprising first and second mould supports, mechanism for rotating each of the mould supports eccentrically beneath a roller shaping tool for the shaping of a piece of clay on an oval mould on the mould support, a first tool supporting head associated with the first mould support and carrying a rotatable roller tool in the form of a spreading tool, a second tool supporting head associated with the second mould support and carrying a rotatable roller tool in the form of a finishihg tool, and tool advancing means operable to bring the roller tools on their tool supporting heads into engagement with pieces of clay on moulds positioned on the eccentrically rotating mould supports, whereby in use of the machine a clay piece can initially undergo a spreading and initial shaping operation by the action of the spreading tool whilst the mould is eccentrically rotated by the first mould support, and then undergo a final shaping operation by the action of the finishing tool whilst the mould is eccentrically rotated by the second mould support.

2. Apparatus according to claim 1 wherein the mechanism for rotating the first mould support is arranged to rotate a mould at two different speeds during the shaping of clay by the spreading tool against the mould, initially at a first speed and thereafter at a higher speed.

3. Apparatus according to claim 1 in which the finishing tool comprises a circumferential groove arranged to form a foot on the ware.

4. Apparatus according to claim 1, in which said tool advancing means is operative to cause the spreading tool to approach a mould, in shaping a piece of clay, at a speed which is reduced as the tool approaches the end of its stroke.

5. Apparatus according to claim 1 comprising means for rotating the spreading tool at a predetermined speed during the shaping of clay, the finishing tool being arranged to rotate freely in contact with a piece of clay.

6. Apparatus according to claim 1 comprising means for rotating both the spreading and the finishing tools at predetermined speeds during the shaping of clay.

7. Apparatus according to claim 1 comprising means for moving the spreading tool a short distance generally radially across the mould while shaping a piece of clay.

8. Apparatus according to claim 1 in which the tool supporting heads are pivotally mounted for movement of the tools towards and away from the mould supporting mechanisms.

9. Apparatus according to claim 1 in which the tool supporting heads are pivotally mounted for movement of the tools towards and away from the mould supporting mechanisms, each of the tool supporting heads comprising a cam follower for imparting a pivoting motion to the head from a revolving cam shaft of the tool advancing means.

10. Apparatus according to claim 9 in which a pair of pivot shafts are positioned in spaced relation and on a common longitudinal axis, the tool supporting heads being pivotally supported by the pivot shafts.

11. Apparatus according to claim 10 in which the cam shaft is positioned in spaced parallel relation to the longitudinal axis of the pivot shafts.

12. Apparatus according to claim 8 in which the tool supporting head carrying the spreading tool is of sufficient weight to progressively spread the clay over the mould and shape the same.

13. Apparatus according to claim 8 in which a tensioning arm is positioned on the tool supporting head carrying the spreading tool and in oppositely disposed relation to the free end thereof, a piston rod of a piston and cylinder assembly engaging the tensioning arm so that motion originated by the piston and cylinder assembly increases the tension applied to the spreading tool.

14. Apparatus according to claim 9 comprising a pivotally mounted rocker arm, a rocker shaft pivotally engaging the rocker arm and extending to a point adjacent the cam shaft, and a secondary rocker arm engaging a cam on the cam shaft, the rocker shaft being pivotally engaged on the secondary rocker arm whereby rocking action can be imparted to the spreading tool when the cam shaft revolves.

15. Apparatus according to claim 14 in which spring tensioning means is positioned between the tool supporting head and the rocker arm and arranged to urge the rocker arm in a direction opposite to the direction of motion imparted to the rocker arm by the secondary rocker arm and the rocker shaft.

16. Apparatus according to claim 9 comprising vacuum actuated chucks in the mould supporting mechanisms, a vacuum source for the chucks, and means responsive to one of the cams on the cam shaft for actuating the chucks.

17. Apparatus according to claim 10 in which the tool supporting heads are pivotally supported on the pivot shafts so that their free ends are positioned outwardly of one side of the pivot shafts and the cam followers are positioned on the opposite sides of the pivot shafts and substantially closer thereto than the free ends of the tool supporting heads.

18. Apparatus according to claim 1 in which the spreading tool is rotatably mounted in a bearing which is pivotally mounted in the tool supporting head, whereby the angle of engagement of the tool on the clay can be continuously changed so as to knead the clay during the spreading and shaping thereof.

19. Apparatus according to claim 5 comprising a braking device adjacent the finishing tool and means for actuating the braking device so as to hinder or stop the free rotation of the tool so that the tool slidingly engages the clay to impart a smooth finish thereto.

* * * * *

UNITED STATES PATENT AND TRADEMARK OFFICE

CERTIFICATE OF CORRECTION

PATENT NO. : 4,368,021

DATED : January 11, 1983

INVENTOR(S) : George Ryckman, deceased, by Margaret V. Ryckman, executrix

It is certified that error appears in the above-identified patent and that said Letters Patent is hereby corrected as shown below:

On the title page, under Related U.S. Application Data

"Apr. 4, 1979" should read -- Apr. 12, 1979 --.

Signed and Sealed this

*Twenty-sixth* Day of *March 1985*

[SEAL]

*Attest:*

DONALD J. QUIGG

*Attesting Officer*

*Acting Commissioner of Patents and Trademarks*